US006712713B1

(12) United States Patent
Lundgren

(10) Patent No.: US 6,712,713 B1
(45) Date of Patent: Mar. 30, 2004

(54) FASCIA AND SHOE MOLDING FOR A BOWLING CENTER AND METHOD

(76) Inventor: Donald J. Lundgren, 540 Ridgewood Rd., Elk Grove Village, IL (US) 60007

( * ) Notice: Subject to any disclaimer, the term of this patent is extended or adjusted under 35 U.S.C. 154(b) by 0 days.

(21) Appl. No.: 10/277,411

(22) Filed: Oct. 22, 2002

Related U.S. Application Data

(60) Provisional application No. 60/357,495, filed on Feb. 16, 2002.

(51) Int. Cl.[7] ..... A63D 1/00
(52) U.S. Cl. ..... 473/115; 362/153
(58) Field of Search ..... 473/115, 54; 362/145, 362/146, 153, 217, 364, 806; 273/DIG. 24

(56) References Cited

U.S. PATENT DOCUMENTS

| | | | | |
|---|---|---|---|---|
| 5,823,655 A | * | 10/1998 | Brooks | 362/145 |
| 5,846,138 A | * | 12/1998 | Borden et al. | 473/54 |
| 5,904,017 A | * | 5/1999 | Glatz et al. | 52/287.1 |
| 6,416,200 B1 | * | 7/2002 | George | 362/146 |
| 6,554,446 B1 | * | 4/2003 | Walsh et al. | |

* cited by examiner

*Primary Examiner*—William M. Pierce
(74) *Attorney, Agent, or Firm*—Mathew R. P. Perrone, Jr.

(57) ABSTRACT

In the form of a cover for the edge of an approach at a bowling center with a fascia or shoe molding composition in the form of a synthetic polymer, preferably black in color, suitable for use in a bowling center, a glow rod or a glow dowel may be set in the synthetic polymer, in order to permit bowling under a black system.

15 Claims, 7 Drawing Sheets

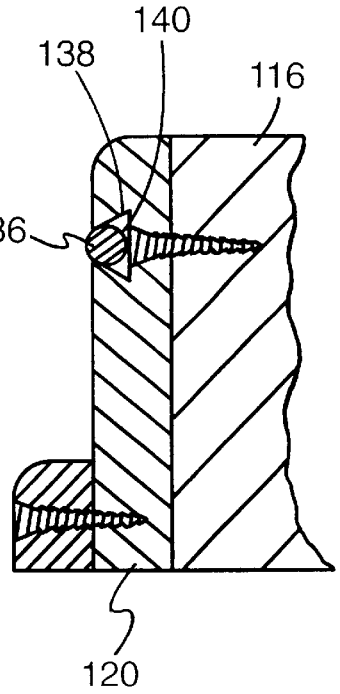
Fig.5.
Fig.6.
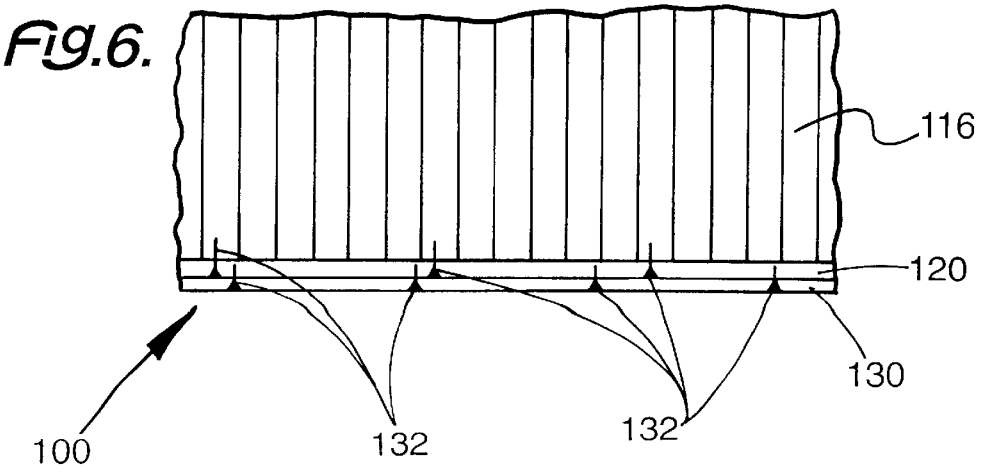

FASCIA AND SHOE MOLDING FOR A BOWLING CENTER AND METHOD

CROSS-REFERENCE TO RELATED APPLICATION

This application claims priority based on a provisional application, and has the same inventive entity as this application. The Provisional Application has a filing date of Feb. 16, 2002, and an Application Number of No. 60/357,495, which application is incorporated herein by reference.

This invention relates to a bowling industry; and more particularly to a fascia and shoe molding for the bowling industry in general, and a bowling center in particular and a method for installing the same.

BACKGROUND OF THE INVENTION

As a way of drawing bowlers into a bowling establishment, many proprietors provide various decorations and make efforts to keep the establishment in a condition to have positive aesthetic effect on the clientele. Some decorations are practical. Others are provided solely for the attractive features.

A fascia is used at a bowling center to protect the edge of the approach to the lane. Not only does a fascia offer some protection, it may also add a decorative function to a particular bowling center. With the prospect or use of fascia or shoe molding for the edge of the approach, each bowling lane at the bowling center is looking for both durability and an appropriate aesthetic appearance.

Many problems exist with the conventional, wooden fascia. With a wooden fascia, the wood cracks and wears down, especially on the top edge, over a period of time. Such fascia needs to be refinished, and clear-coated or painted, at least once during the year. Such refinishing is both time consuming and costly. Yet, at the current time, it is necessary, if not mandatory.

Customarily, conventional fascia has the same color as the wood of the approach to each lane. This color similarity conceals the edge of the approach, which may lead to a prospective bowler tripping, or otherwise making a misstep. Yet, with the required refinishing process, a change in the color is difficult to achieve in an effective and efficient fashion.

It is always desirable to minimize the possibility of such an accident. A typical manner of minimizing the chance of a misstep is by a change in color in the area where a misstep might be made. At a bowling center, especially on the approaches to each lane, it is very difficult to make an appropriate color change, while maintaining the aesthetic appearance of each lane in particular and the entire bowling in general.

If a suitable method and composition can be developed or use as molding or fascia, greater advantages can be obtained. This product can last longer and provide greater safety. Also, costs of maintaining a bowling center might be reduced.

SUMMARY OF THE INVENTION

Among the many objectives of this invention is the provision of a fascia or shoe molding composition for the bowling industry at the edge of the approach.

A further objective of this invention is the provision of a durable fascia or shoe composition.

A still further objective of this invention is the provision of a fascia for a bowling center, with reduced wear.

Yet a further objective of this invention is the provision of a fascia for a bowling center, with reduced cracking.

Also, an objective of this invention is the provision of a fascia for a bowling center, with a desired color.

Another objective of this invention is the provision of a fascia for a bowling center, with a durable finish.

Yet, another objective of this invention is the provision of a fascia for a bowling center, with reduced accident danger.

Still another object is the provision of a fascia and shoe molding for the bowling industry that is a permanent replacement for the old wood.

A further object is to provide a fascia and shoe molding for the bowling industry that requires no maintenance to the bowling center for many years.

These and other objectives of the invention (which other objectives become clear by consideration of the specification, claims and drawings as a whole) are met by providing a cover for the edge of an approach at a bowling center with a fascia or shoe molding composition in the form of a synthetic polymer, preferably black in color, suitable for use in a bowling center, and into which, may be placed a glow rod or a glow dowel may be set in the synthetic polymer, in order to permit bowling under a black light system.

BRIEF DESCRIPTION OF THE DRAWINGS

FIG. 5 depicts a side, cross-sectioned view of a approach 116 using molded fascia 100 of this invention, with a glow rod 140, based on FIG. 3.

FIG. 6 depicts a top plan view of approach 116 using molded fascia 100 of this invention.

Throughout the figures of the drawings, where the same part appears in more than one figure of the drawings, the same number is applied thereto.

DESCRIPTION OF THE PREFERRED EMBODIMENTS

With a molded polyethylene or other polymer, the fascia and molding on the approach to a bowling center may be greatly improved. This structure is the entity approach to substantiate that a nice finish, which appears new for a substantial period of time, is provided with the additional advantage of minimal maintenance.

The two main components of this product are the piece fascia and the shoe molding. Another alternate version of the fascia, is that a portion of the fascia may become glowable and have a glow-in-the-dark feature, especially under black lights or black lighting system. Bowling under these lighting conditions is or is becoming very popular.

Such a structure provides a nice accent to the edge of the approach, not only for its aesthetic effect, but also for safety. The different colored molding by itself or with the black lights provides a more clear indication of where the approach begins, and minimizes the chance tripping or falling by a bowler in that area.

No operation function is required for the fascia and shoe molding. Once it is installed, maintenance of that area is greatly reduced. The main function is to finish off the approach area, and highlight an area where otherwise someone might trip or suffer an injury.

In a preferred form, the fascia and shoe molding is formed from a high impact polymer, preferably a homopolymer. However, high impact colored copolymers are also useful. An especially preferred polymer is black, high impact polyethylene.

Each piece of homopolymer is about two to three centimeters thick, about 20 to 40 centimeters wide and about three to four meters long. The preferred polymer is black high impact polyethylene, because of its availability, cost, durability, flexibility and ease of use. The black, high impact polyethylene is preferably the material used. This structure permits an efficient use of material and construction time.

With the high impact capabilities of this material, the increase in time for an appropriate and acceptable appearance fascia and molding on the bowling approach is greatly improved. In other words, for the material of this invention, the severity of treatment resulting from use in a bowling center still provides both a durable pleasing appearance and protection. Protection comes for both the bowling center and the approach, and the bowler.

Figure 2:
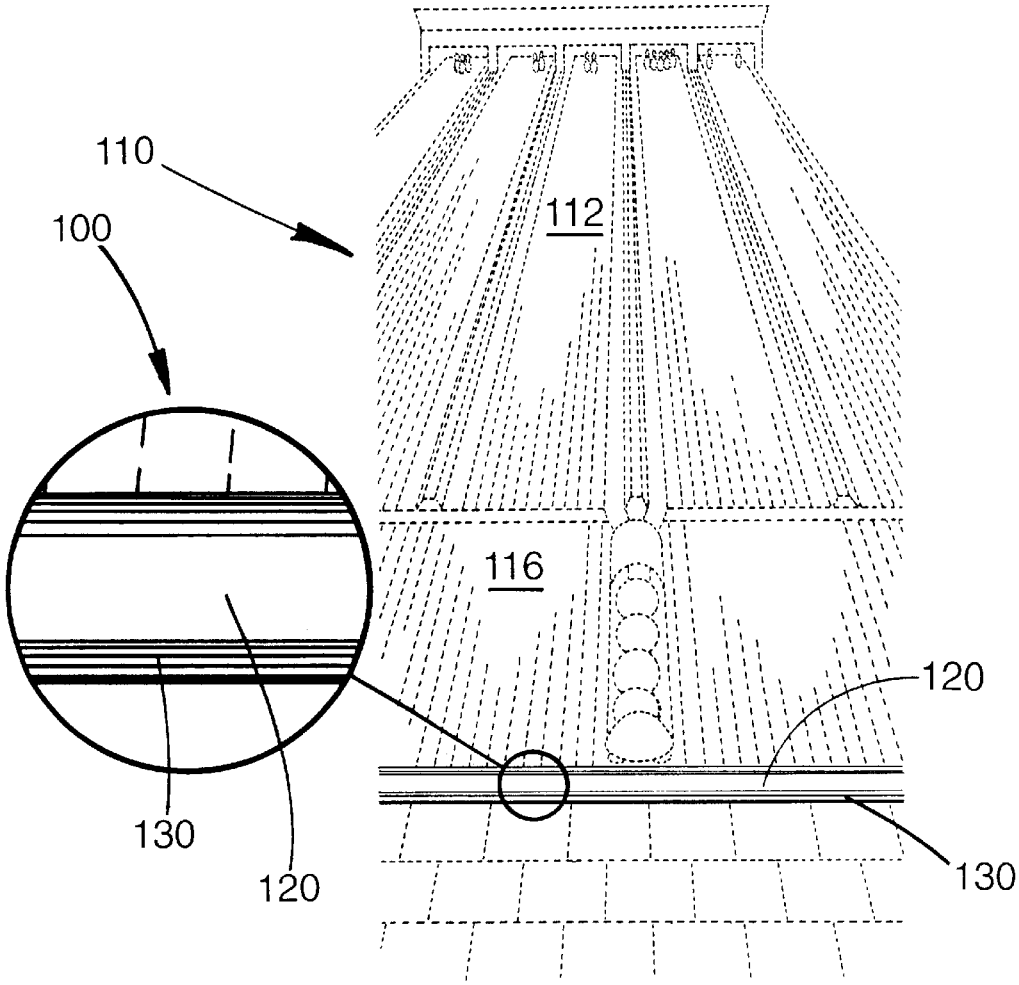
FIG. 2 depicts a perspective view of a bowling center 110 showing a plurality of lanes 112 using molded fascia 100 of this invention.

A preferred material for this application as to fascia board is polyethylene plastic, which material is available in sheets about 1.5 meters by about three meters by two centimeters (five feet by ten feet by 0.75 inch). The height is cut as needed, as shown in FIG. 2, or face board 120. This material or face board 120 is fastened to the edge of existing approach 116, with countersunk laminate screws 132 as shown in FIG. 6. The top edge of the fascia is then trimmed with a laminate trimmer router, even with the existing approach. The last step is to put a radius with molding strip 130 on face board 120 or on the edge of the fascia. The material that is preferred is black, but a wide variety of colors is available in certain colors in order to match a decoration scheme in a particular bowling center.

Figure 1:
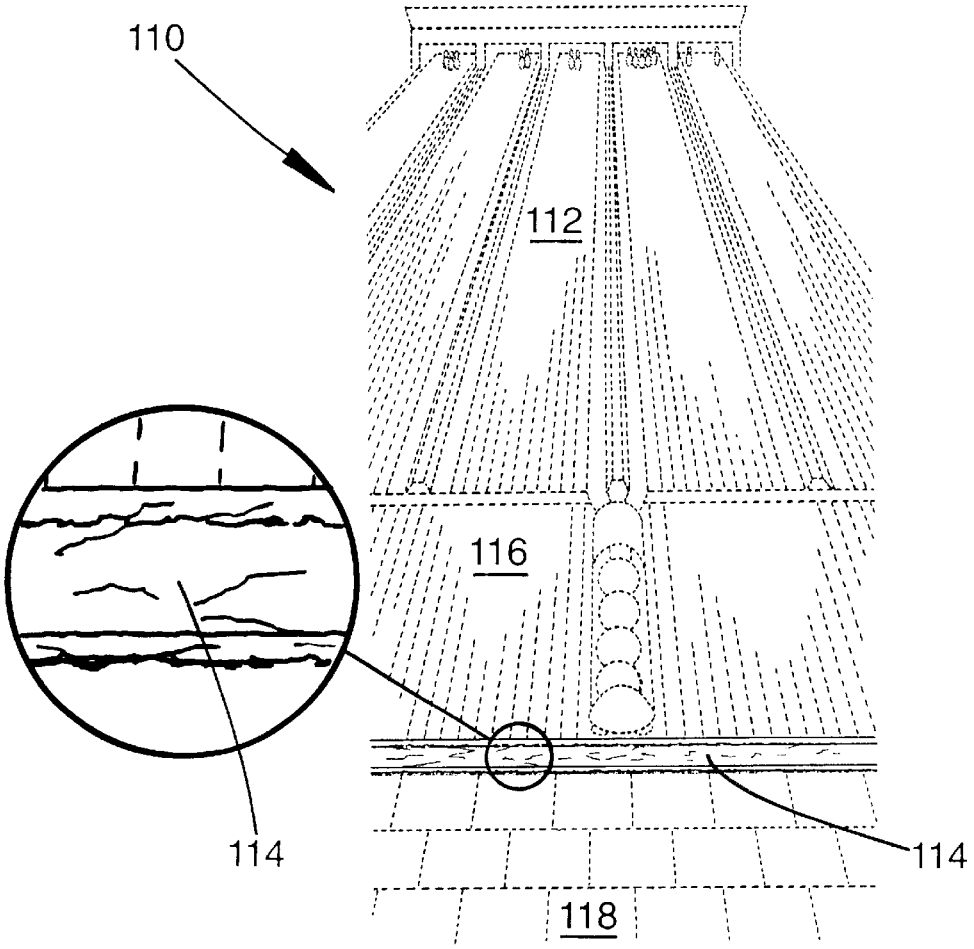
Fig. 1. PRIOR ART
FIG. 1 depicts a perspective view of a bowling center 110 showing a plurality of lanes 112 using the wood fascia 114 of the prior art.

Referring now to FIG. 1, a bowling center 110 of the prior art has lanes 112 with wood fascia 114 on the approach 116. Completely lacking is a distinction between the approach 116 and waiting area 118. Such a structure conceals the approach and can lead to substantial problems.

With the consideration of FIG. 2, molded fascia 100 overcomes those problems. Molded fascia 100 has a face board 120 on the approach 116. Adjacent to the face board 120 is a molding strip 130. Molding strip 130 adds trim with a neat appearance for the approach 116.

Figure 3:
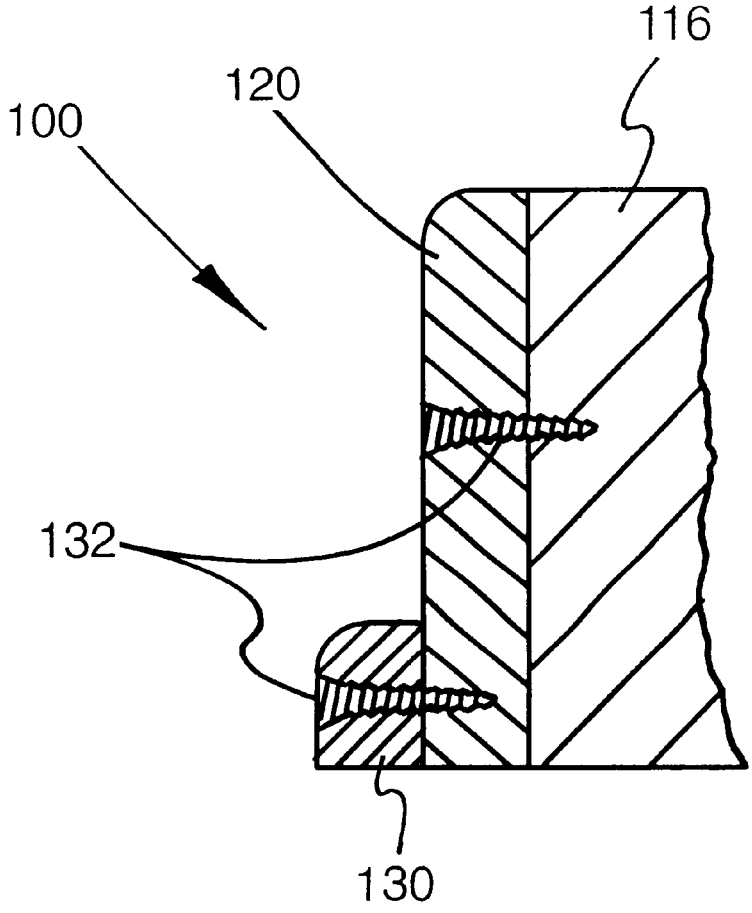
FIG. 3 depicts a side, cross-sectioned view of a single lane 112 using molded fascia 100 of this invention, based on FIG. 2.

With the consideration of FIG. 3, laminate screws 132 secure molding strip 130 to those face board 120 and approach 116. Additionally, other laminate screws 132 secure face board 120 to approach 116.

Figure 4:
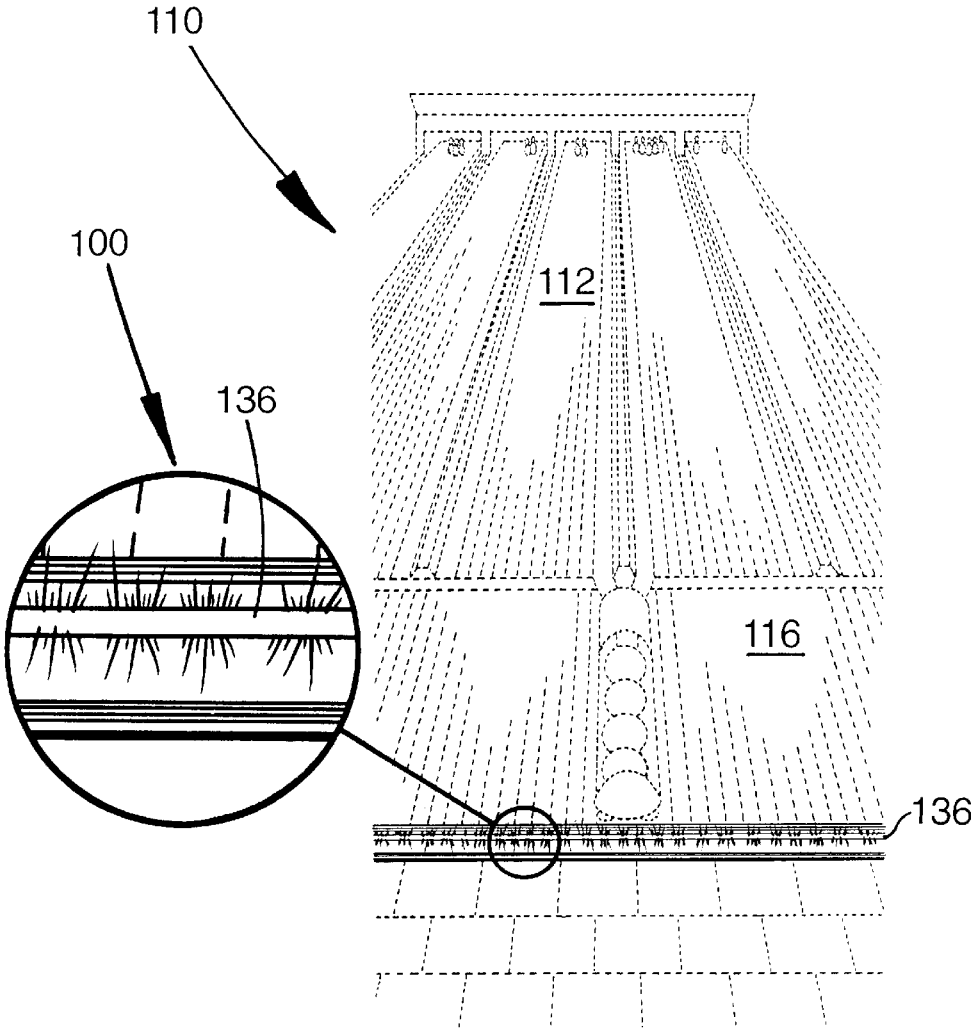
FIG. 4 depicts a perspective view of a bowling center 110 showing a plurality of lanes 112 using molded fascia 100 of this invention, with a glow rod 136.

Turning now to FIG. 4 and FIG. 5, a glow rod 136 is inserted into face board 120 at routed groove 138. Routed groove 138 may be formed in face board 120 by any standard router (not shown) with an appropriate lane therein. Glow rod 136 is also a shaped polymer having reflective material 140 area. Thus, when it is desired to use black light or other unconventional lighting, thanks to glow rod 136, approach 116 can still be visible.

Glow rod 136, under the black light assembly, provides an elongated light. In other words, the length of glow rod 136 provides a band of light, which is long and narrow. However, is band of light matches the structure of glow rod 136.

Adding FIG. 6 to the consideration, laminate screws 132 are shown in a proper position to hold face board 120 and molding strip 130 where desired on approach 116. In this fashion, molded fascia 100 is properly secured thereto.

Figure 7:
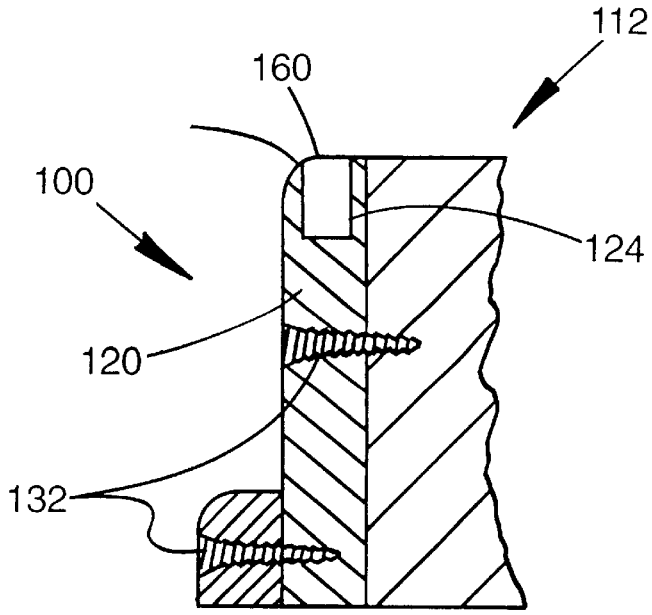
FIG. 7 depicts a side, cross-sectioned view of a single lane 112 using molded fascia 100 of this invention, with a glow dowel 160.

In an alternate version as shown in FIG. 7, a single lane 112 uses molded fascia 100 of this invention, with a glow dowel 160. Glow dowel 160 is positioned in top edge 122 of face board 120. Glow dowel 160 may have any suitable color and indicate the edge 122 of face board 120. Glow dowel 160 is preferably a short cylindrical piece of material capable of being inserted into top edge 122 by virtue of aperture 124. Glow dowel 160 is held in position by friction, or glue if desired.

Glow dowel 160 provides little areas of light under the black light system based usually on the cross-sectional area of the glow dowel 160. As many of glow dowel 160 as desired may be used.

Figure 8:
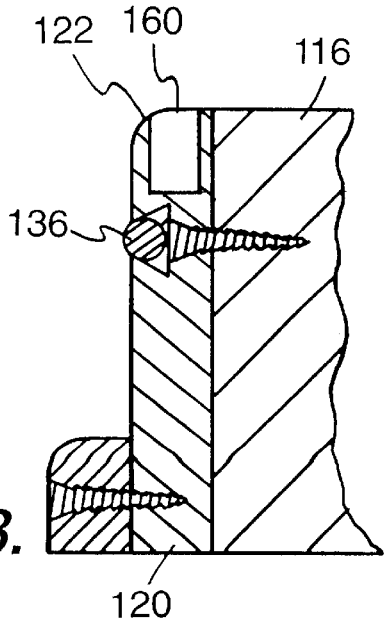
FIG. 8 depicts a side, cross-sectioned view of a single lane 112 using molded fascia 100 of this invention, with a glow rod 140, based on FIG. 3, with the further addition of glow dowel 160.
Figure 9:
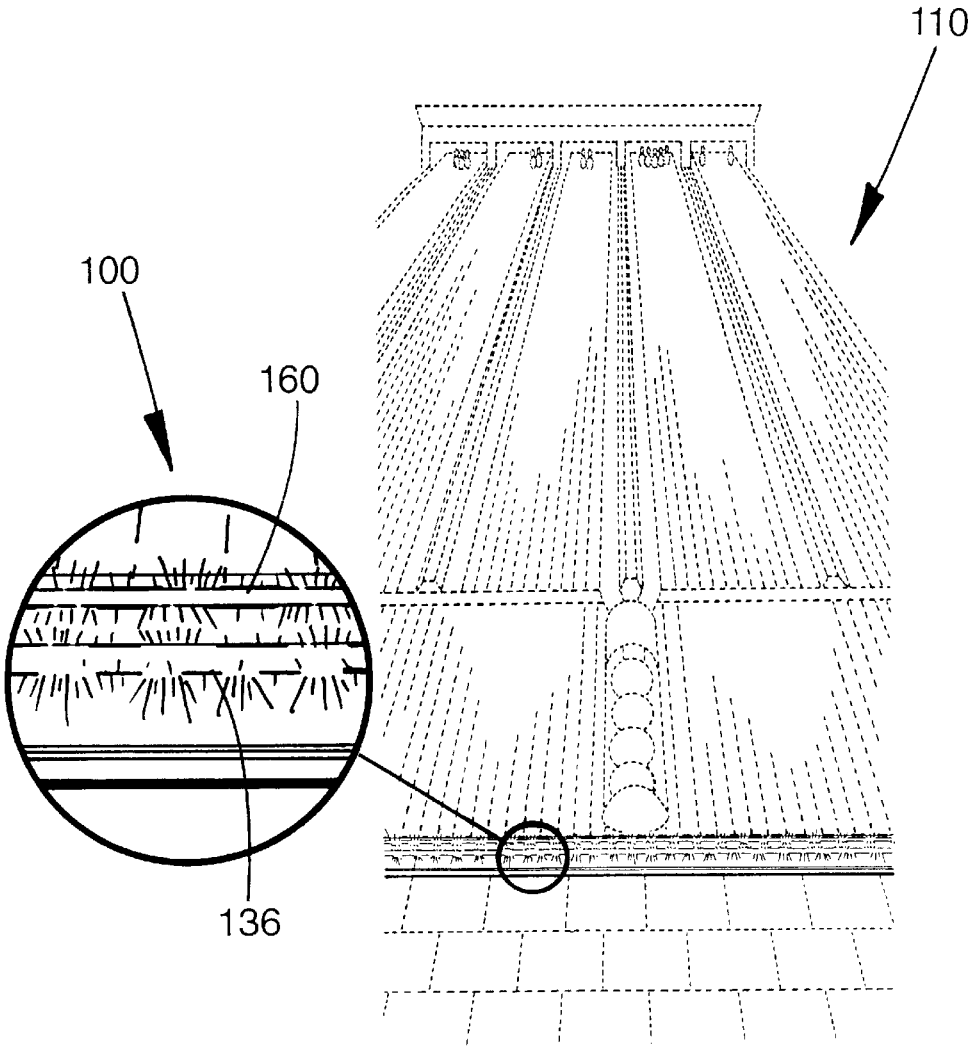
FIG. 9 depicts a perspective view of a bowling center 110 showing a plurality of lanes 112 using molded fascia 100 of this invention, with a glow rod 136 and glow dowel 160 being used.

Clearly from FIG. 8 and FIG. 9, molded fascia 100 may have both a glow rod 136, and glow dowel 160 or a plurality thereof, used in combination. Such a structure greatly adds to the aesthetic appearance of bowling center 110, if not the safety features thereof.

The following examples are intended to illustrate without unduly limiting the scope of this invention.

EXAMPLE 1

A piece of plastic fascia and a plastic shoe molding is obtained. The fascia is black polyethylene homopolymer plastic, about 1.9 centimeters or 0.75 inch thick. The height of the fascia varies from 1 inch to 9 inches. This product is usually obtained in lengths of about three meters or 10 feet.

The shoe molding is also black polyethylene homopolymer plastic, about 1.9 centimeters or 0.75 inch thick.

The fascia board is the finishing touch to the approach edge of a bowling lane. From the first years, bowling lanes were installed, until right now, polyethylene replaces wood which is now used for the approach edge of a bowling lane. Such polyethylene is available in a sheet of about 1.5 meters by about three meters in surface area and about 1.9 centimeters thick (about 5 feet by about 10 feet surface area and about 0.75 inch thick). From the sheet, is cut the height as needed for the face board 120, as shown in FIG. 2. This material is fastened to the edge of the existing approach 116 as shown in FIG. 6, with laminate screws 132.

EXAMPLE 2

The procedure of Example 1 is repeated with modifications. In FIG. 5, glow rod 136 is inserted into routed groove 138. Routed groove 138 is formed in face board 120 by a router (not shown). A piece of glow rod 136 is secured in routed groove 138 by glue, nails or other appropriate fastening device. More particularly glow rod 136 is preferably round diameter rod having a diameter of about 0.85 centimeter (0.375 inch). With glow rod 136, reflective material 140 shows or glows in the dark, and provides some direction and orientation under a standard black light assembly. This glows-in-the-dark system is a form of fun bowling, where the lights are turned off and black lights are activated. This bowling under black provides an attractive and effective manner of bowling, where the lanes glow, the bowling balls glow, and the pins glow. With the standard lights turned out, it is hard to see the step up on the approach, This fascia 100 makes it easy to see this step up for approach 116, because it glows in the dark.

The shoe molding or molding strip 130 is also black polyethylene homopolymer plastic about 1.9 centimeters thick (about 0.75 inch thick). The height is about 2.54 centimeters (one inch) and is sold in lengths of about three meters (10 feet. The shoe molding or molding strip 130 puts the finishing touch on the area where the approach 116 and face board 120 meet. This material is also polyethylene plastic and may also be cut from the above-described sheets. Then a radius is put on the shoe molding or molding strip 130, with a router (not shown). Dimensions can be clearly adjusted.

EXAMPLE 3

The procedure of Example 1 is repeated with apertures 124 been formed in top edge 122 days board 120. Into each aperture 124, a glow dowel 160 is inserted. The friction positions glow dowel 160 in the aperture 124.

EXAMPLE 4

The procedures of Example 2 and Example 3 are combined so that both a number of glow dowels 160 are used in combination with glow rod 136. The combination of glow dowels 160 and glow rod 136 provide a very safe and an acceptable appearance for the bowling center 110.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

This application; taken as a whole with the specification, claims, abstract, and drawings; provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters of the United States is:

1. A fascia and shoe molding for use in a bowling center comprising:

(a) a high impact polymer forming the fascia and shoe molding;

(b) the high impact polymer providing a durable version of the fascia and shoe molding;

(c) the high impact polymer being secured next to at least one lane in a bowling center; and (d) the high impact polymer having a different color than the at least one lane in order to provide a safety factor and a decorative factor;

(e) the fascia having at least one glow rod mounted therein;

(f) the glow rod having a visible color when subjected to a black light system; and (g) the glow rod providing visibility in the bowling center.

2. The fascia and shoe molding of claim 1 further comprising the glow rod providing an elongated glowing light.

3. The fascia and shoe molding of claim 1 further comprising:

(a) the shoe molding having at least one glow dowel set therein;

(b) the at least one glow dowel having a visible color when subjected to a black light system; and (c) the at least one glow dowel providing visibility in the bowling center.

4. The fascia and shoe molding of claim 3 further comprising the at least one glow dowel providing a spot of glowing light.

5. The fascia and shoe molding of claim 4, further comprising the glow rod providing an elongated glowing light.

6. A method of forming fascia and shoe molding for use in a bowling center comprising:

(a) cutting a piece of high impact plastic to a desired shape to form a plain fascia;

(b) securing a glowable material adapted to glow under a black light to the piece of high impact plastic in order to convert the plain fascia into a glowable fascia;

(c) mounting the glowable fascia in the bowling center;

(d) forming a groove in the plain fascia; and (e) securing a glow rod in the groove in order to convert the plain fascia into the glowable fascia.

7. The method of claim 6, further comprising:

(a) cutting a piece of high impact plastic to a desired shape to form a plain shoe molding;

(b) forming at least one aperture in the plain shoe molding; and (c) securing a glow dowel in the at least one aperture in order to convert the plain shoe molding into a glowable shoe molding.

8. The method of claim 6 further comprising adding the glowable shoe molding to the glowable fascia.

9. A fascia and shoe molding for use in a bowling center comprising:

(a) a high impact polymer forming the fascia and shoe molding;

(b) the fascia and shoe molding including a face board and a molding strip;

(c) the high impact polymer for the face board being about two to three centimeters thick, about 20 to 40 centimeters wide and about three to four meters long;

(d) the molding strip being a shaped piece of the high impact polymer;

(e) the fascia having a glow rod mounted therein;

(f) the glow rod having a visible color when subjected to a black light system;

(g) the glow rod providing visibility in the bowling center; and (h) the high impact polymer being next to at least one lane in a bowling center.

10. The fascia and shoe molding of claim 9 further comprising:

(a) the high impact polymer being a homopolymer;

(b) the high impact polymer providing a durable version of the fascia and shoe molding; and (c) the high impact polymer having a different color than the at least one lane in order to provide a safety factor and a decorative factor.

11. The fascia and shoe molding of claim 10 further comprising:

(a) the shoe molding having at least one glow dowel set therein; and (b) the at least one glow dowel having a visible color when subjected to a black light system.

12. The fascia and shoe molding of claim 11 further comprising:

(a) the fascia and shoe molding having a glow rod mounted therein;

(b) the glow rod having a visible color when subjected to a black light system; and (c) the glow rod providing visibility in the bowling center.

13. The fascia and shoe molding of claim 12 further comprising:

(a) the glow dowel being positioned in a top edge of a face board;

(b) the top edge including an aperture for each of the glow dowel inserted therein; and (c) laminate screws holding the face board and the molding strip in position.

14. The fascia and shoe molding of claim 13 further comprising the glow dowel being positioned in the aperture by friction or glue.

15. The fascia and shoe molding of claim 14 further comprising:

(a) a rod groove being formed in the face plate;

(b) the glow rod being positioned in the rod groove; and (c) the glow rod being held in the rod groove by friction or glue.

* * * * *